US008616617B2

(12) United States Patent
Sherbeck et al.

(10) Patent No.: US 8,616,617 B2
(45) Date of Patent: Dec. 31, 2013

(54) LIGHTWEIGHT BLAST RESISTANT ARMORED CAB FOR VEHICLES

(75) Inventors: Timothy David Sherbeck, Katy, TX (US); Ricky D. Johnson, Sealy, TX (US); Tomas Hinojos, Katy, TX (US); Randall D. Behrens, Sealy, TX (US); Adnan Hiros, Azle, TX (US); Dale Smiley, Cincinnati, OH (US)

(73) Assignee: BAE Systems Tactical Vehicle Systems L.P., Sealy, TX (US)

( * ) Notice: Subject to any disclaimer, the term of this patent is extended or adjusted under 35 U.S.C. 154(b) by 100 days.

(21) Appl. No.: 13/279,912

(22) Filed: Oct. 24, 2011

(65) Prior Publication Data

US 2012/0097019 A1 Apr. 26, 2012

Related U.S. Application Data

(60) Provisional application No. 61/406,214, filed on Oct. 25, 2010.

(51) Int. Cl.
*F41H 7/02* (2006.01)

(52) U.S. Cl.
USPC ..... 296/187.07; 89/36.08; 296/193.07

(58) Field of Classification Search
USPC ..... 296/187.07, 190.03, 203.01, 187.08, 296/193.07; 89/36.08, 36.09
See application file for complete search history.

(56) References Cited

U.S. PATENT DOCUMENTS

| | | | | |
|---|---|---|---|---|
| 4,215,645 | A | 8/1980 | Moeller | |
| 4,280,393 | A * | 7/1981 | Giraud et al. | 296/187.07 |
| 4,593,870 | A | 6/1986 | Cronkhite et al. | |
| 6,779,431 | B2 | 8/2004 | Honlinger | |
| 6,805,401 | B2 | 10/2004 | Hayashi et al. | |
| 6,834,912 | B2 | 12/2004 | Cardimen et al. | |
| 7,195,306 | B2 | 3/2007 | Egawa et al. | |
| 7,228,927 | B2 | 6/2007 | Hass et al. | |
| 7,357,062 | B2 | 4/2008 | Joynt | |
| 7,594,561 | B2 | 9/2009 | Hass et al. | |
| 7,712,823 | B2 * | 5/2010 | Greuter et al. | 296/187.07 |
| 7,770,506 | B2 | 8/2010 | Johnson et al. | |
| 8,096,225 | B1 | 1/2012 | Johnson et al. | |
| 2005/0284682 | A1 | 12/2005 | Hass et al. | |

(Continued)

FOREIGN PATENT DOCUMENTS

| | | |
|---|---|---|
| CA | 2618136 | 2/2007 |
| EP | 0828134 | 3/1998 |

(Continued)

OTHER PUBLICATIONS

PCT/US2011/057681 Search Report and Written Opinion Mail Date: Jan. 30, 2012.

*Primary Examiner* — Jason S Morrow
*Assistant Examiner* — E Turner Hicks
(74) *Attorney, Agent, or Firm* — Wood, Herron & Evans, LLP

(57) ABSTRACT

An armored cab comprises a top wall, two side walls, a front wall, a back wall, and a bottom wall. The cab has a longitudinal axis extending from the back wall to the front wall. The bottom wall includes a first downwardly facing convex wall, at least a second downwardly facing convex wall above the first convex wall, and a plurality of connecting members interconnecting the first convex wall and the at least a second convex wall.

41 Claims, 13 Drawing Sheets

(56) References Cited

U.S. PATENT DOCUMENTS

| | | | | |
|---|---|---|---|---|
| 2007/0084337 | A1* | 4/2007 | Strassgurtl et al. | 89/36.08 |
| 2007/0186762 | A1 | 8/2007 | Dehart et al. | |
| 2007/0234896 | A1* | 10/2007 | Joynt | 89/36.09 |
| 2008/0066613 | A1 | 3/2008 | Mills et al. | |
| 2009/0058142 | A1 | 3/2009 | Park | |
| 2009/0293712 | A1* | 12/2009 | Ran et al. | 89/36.08 |
| 2010/0011948 | A1 | 1/2010 | Johnson et al. | |
| 2010/0163330 | A1* | 7/2010 | Halliday | 180/295 |
| 2010/0218667 | A1* | 9/2010 | Naroditsky et al. | 89/36.02 |
| 2011/0138994 | A1* | 6/2011 | Joynt et al. | 89/36.08 |
| 2011/0197744 | A1* | 8/2011 | Cox | 89/36.02 |
| 2011/0314999 | A1* | 12/2011 | Luther et al. | 89/36.02 |
| 2012/0186428 | A1* | 7/2012 | Peer et al. | 89/36.02 |
| 2012/0192708 | A1* | 8/2012 | Kocher et al. | 89/36.08 |

FOREIGN PATENT DOCUMENTS

| | | | |
|---|---|---|---|
| EP | 828134 | A2 * | 3/1998 |
| EP | 1574812 | | 9/2005 |
| EP | 1754949 | | 2/2007 |
| EP | 1821061 | | 8/2007 |
| EP | 2128558 | | 12/2009 |
| WO | 0239048 | | 5/2002 |
| WO | 03102489 | | 12/2003 |
| WO | 2007088071 | | 8/2007 |
| WO | WO 2007088071 | A2 * | 8/2007 |
| WO | 2008069807 | | 6/2008 |
| WO | 2008127272 | | 10/2008 |
| WO | 2009102364 | | 8/2009 |
| WO | 2009140331 | | 11/2009 |

* cited by examiner

LIGHTWEIGHT BLAST RESISTANT ARMORED CAB FOR VEHICLES

RELATED APPLICATIONS

This application claims priority to U.S. Provisional Patent Application Ser. No. 61/406,214 filed Oct. 25, 2010, which is hereby incorporated by reference herein as if fully set forth in its entirety.

FIELD OF THE INVENTION

This invention relates generally to armored vehicles, and more particularly to a lightweight blast resistant armored cab for vehicles.

BACKGROUND OF THE INVENTION

It is often desirable to transport troops, non-military personnel, and equipment across hostile territory via motorized land vehicles such as tactical vehicles, tactical trucks, and similar vehicles. Such vehicles may sustain land mine strikes, or attacks from improvised explosive devices ("IED's"), such as roadside bombs. During transport, people occupying the passenger cabin or cab of the vehicle are susceptible to injury from land mines, IED's, and other bombs and explosives. To withstand the forces of the foregoing types of attacks and explosions and to enhance the survivability of the occupants of the vehicle, it is known to armor the cab of the vehicle with armor plating.

Typical prior vehicle cabs were armored by increasing blast resistance through the use of increased material strength and thickness, as well as increasing blast deflection through the use of angular and "V" shaped structures. Prior "V" shaped hull structures include those with two planar portions angled relative to one another and defining a vertex intermediate the transverse dimension of the vehicle, those with three planar portions angled relative to one another with the intermediate planar portion located intermediate the transverse dimension of the vehicle and oriented generally parallel to the ground surface, and those with four planar portions angled relative to one another and defining a vertex intermediate the transverse dimension of the vehicle. Prior vehicles so armored could be too heavy, too tall, or too expensive. Accordingly, further improvement in the area of armored cabs is desired.

SUMMARY OF THE INVENTION

In one aspect, an armored cab comprises a top wall, two side walls, a front wall, a back wall, and a bottom wall. The cab has a longitudinal axis extending from the back wall to the front wall. The bottom wall includes a first downwardly facing convex wall generally parallel to the longitudinal axis of the cab, at least a second downwardly facing convex wall generally parallel to the longitudinal axis of the cab above the first convex wall, and a plurality of connecting members interconnecting the first convex wall and the at least a second convex wall.

The first convex wall and the at least a second convex wall can be any arched shape. For example, the first convex wall and the at least a second convex wall can be cylindrical. The first convex wall can have a first radius of curvature and the at least a second convex wall can have a second radius of curvature; the first radius of curvature can be greater than the second radius of curvature. The at least a second convex wall can comprise second, third and fourth downwardly facing convex walls generally parallel to the longitudinal axis of the cab positioned across a transverse extent of the first convex wall. The second, third, and fourth convex walls can be cylindrical. Each of the second, third, and fourth convex walls can have a respective radius of curvature; the first radius of curvature can be greater than the second, third, and fourth radii of curvature. The third radius of curvature can be greater than the second radius of curvature and the fourth radius of curvature, and the third convex wall can be positioned between the second convex wall and the fourth convex wall. The first radius of curvature can be about 2300 millimeters, the second radius of curvature can be about 400 millimeters, the third radius of curvature can be about 450 millimeters, and the fourth radius of curvature can be about 400 millimeters.

The plurality of connecting members can comprise a first plurality of ribs generally parallel to the longitudinal axis of the cab and a second plurality of ribs generally perpendicular to the longitudinal axis of the cab, the first and second pluralities of ribs connected to the first convex wall, to the at least a second convex wall, and to each other.

The first convex wall can be formed from a plurality of elongated connected planar sections generally parallel to the longitudinal axis of the cab. The planar sections can be angled relative to one another by less than about 18 degrees. For example, the first convex wall can be formed from five or more such planar sections, or six such planar sections or ten such planar sections. In the case of the first convex wall being formed from ten such planar sections, the first plurality of ribs generally parallel to the longitudinal axis of the cab can comprise nine ribs, and the second plurality of ribs generally perpendicular to the longitudinal axis of the cab can comprise twelve ribs.

The cab can further include a power train tunnel, the bottom wall forming a lower portion of a power train tunnel enclosure defining the power train tunnel.

The bottom wall can further include a planar front end wall and a planar rear end wall, with the front end wall extending downwardly and rearwardly from an upper front edge thereof, and the rear end wall extending downwardly and forwardly from an upper rear edge thereof. The front end wall and said rear end wall can be adapted to have attached thereto front frame rail stubs and rear frame rail stubs, respectively, of a vehicle frame.

In another aspect, an armored cab comprises a top wall, two side walls, a front wall, a back wall, and a bottom wall. The cab has a longitudinal axis extending from the back wall to the front wall. The bottom wall includes a first downwardly facing convex wall generally parallel to the longitudinal axis of the cab, at least a second wall generally parallel to the longitudinal axis of the cab above the first convex wall, and a plurality of connecting members interconnecting the first convex wall and the at least a second wall.

The at least a second wall can be planar or it can be a downwardly facing convex wall. If the at least a second wall is a convex wall, the radius of curvature of the second convex wall can be about equal to, or greater than, the radius of curvature of the first convex wall. The at least a second wall can also comprise second, third, and fourth planar walls generally parallel to the longitudinal axis of the cab positioned across a transverse extent of the first convex wall, the second, third, and fourth planar walls being angled relative to one another. The at least a second wall can also comprise second, third, and fourth downwardly facing convex walls generally parallel to the longitudinal axis of the cab positioned across a transverse extent of the first convex wall, the second convex wall formed from three elongated connected planar sections generally parallel to the longitudinal axis of the cab, the third convex wall formed from four elongated connected planar sections generally parallel to the longitudinal axis of the cab, and the fourth convex wall formed from three elongated connected planar sections generally parallel to the longitudinal axis of the cab. The first convex wall can be formed from five elongated connected planar sections generally parallel to the longitudinal axis of the cab.

The armored cab of this invention helps to cost-effectively meet weight and mine blast requirements for light tactical vehicles without exceeding height requirements and while maintaining sufficient vehicle ground clearance.

The accompanying drawings, which are incorporated in and constitute a part of this specification, illustrate embodiments of the invention and, together with a general description of the invention given above, and the detailed description of the embodiments given below, serve to explain the principles of the present invention.

DETAILED DESCRIPTION OF THE DRAWINGS

Figure 1:
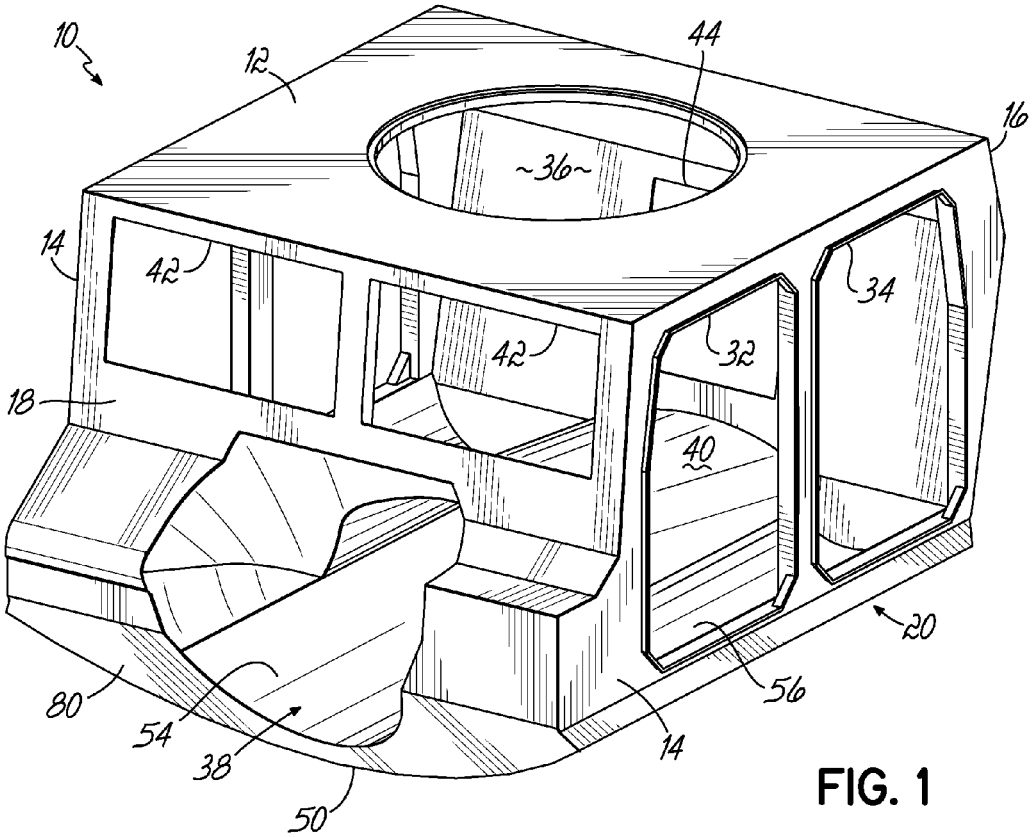
FIG. 1 is a top perspective view of a cab according to the principles of the invention.
Figure 2:
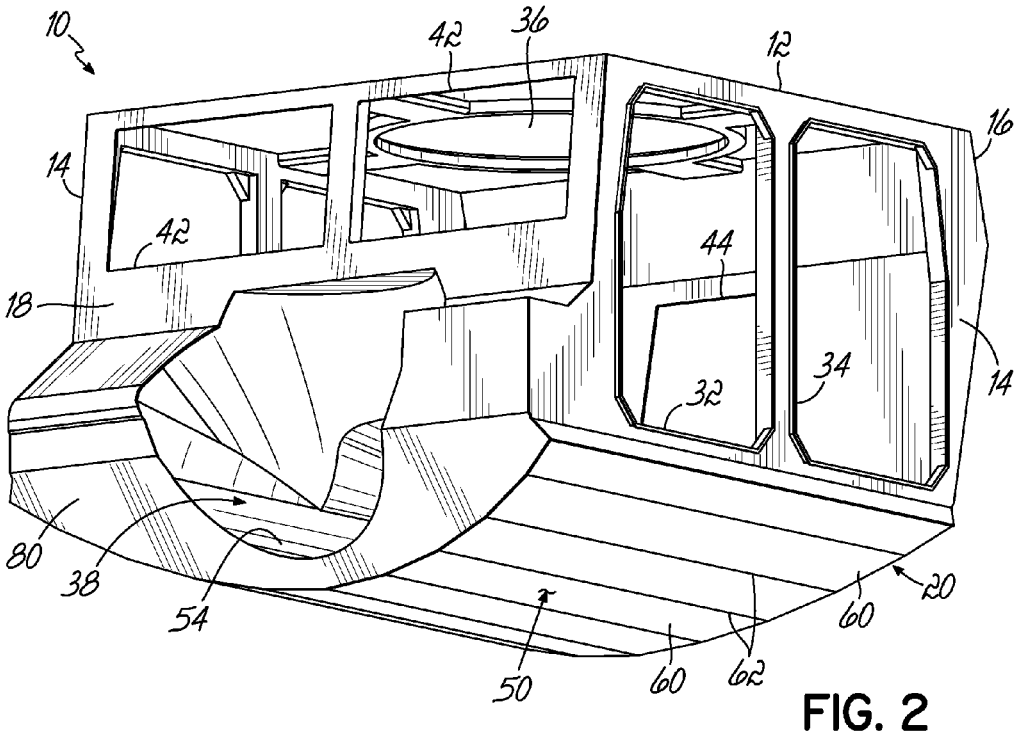
FIG. 2 is a bottom perspective view of the cab of FIG. 1.
Figure 3:
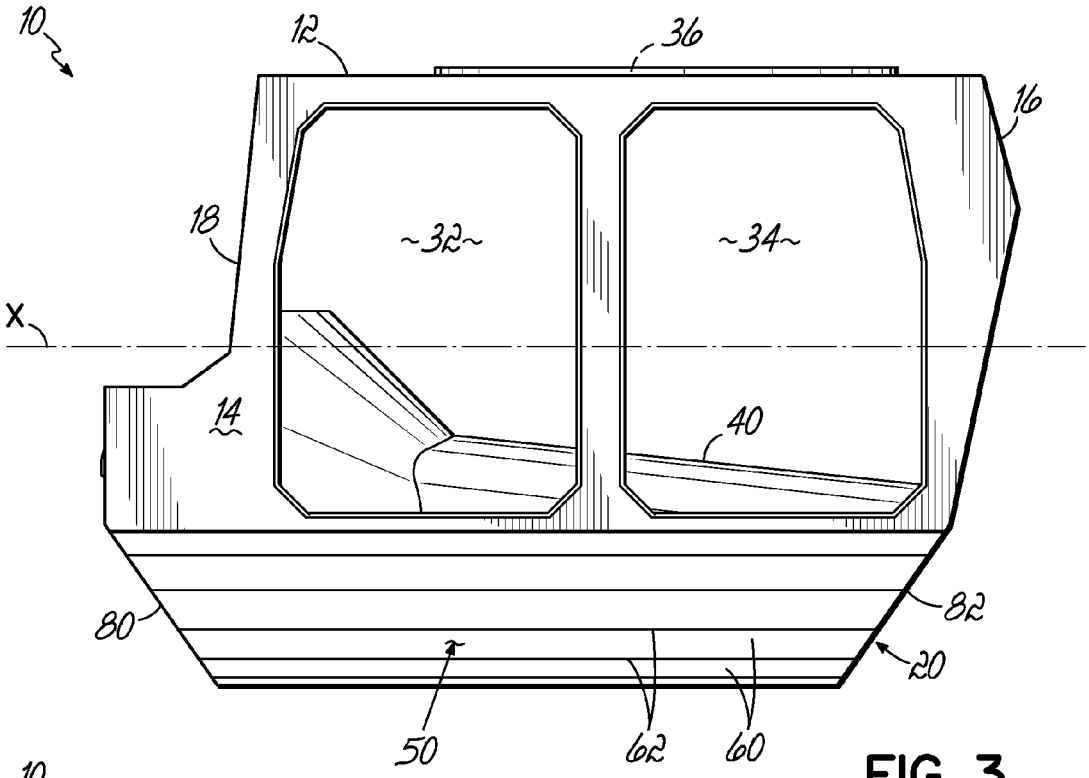
FIG. 3 is a side view of the cab of FIGS. 1 and 2.
Figure 4:
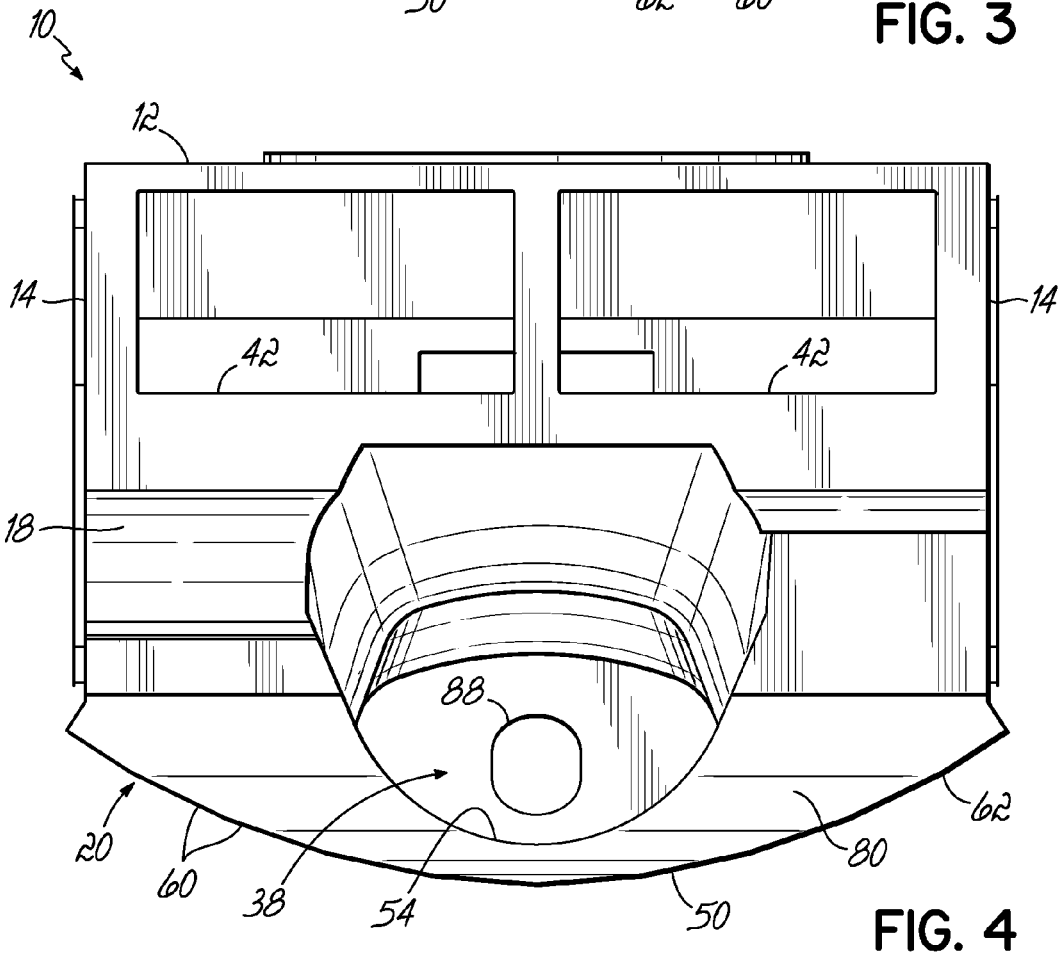
FIG. 4 is a front view of the cab of FIGS. 1-3.
Figure 5:
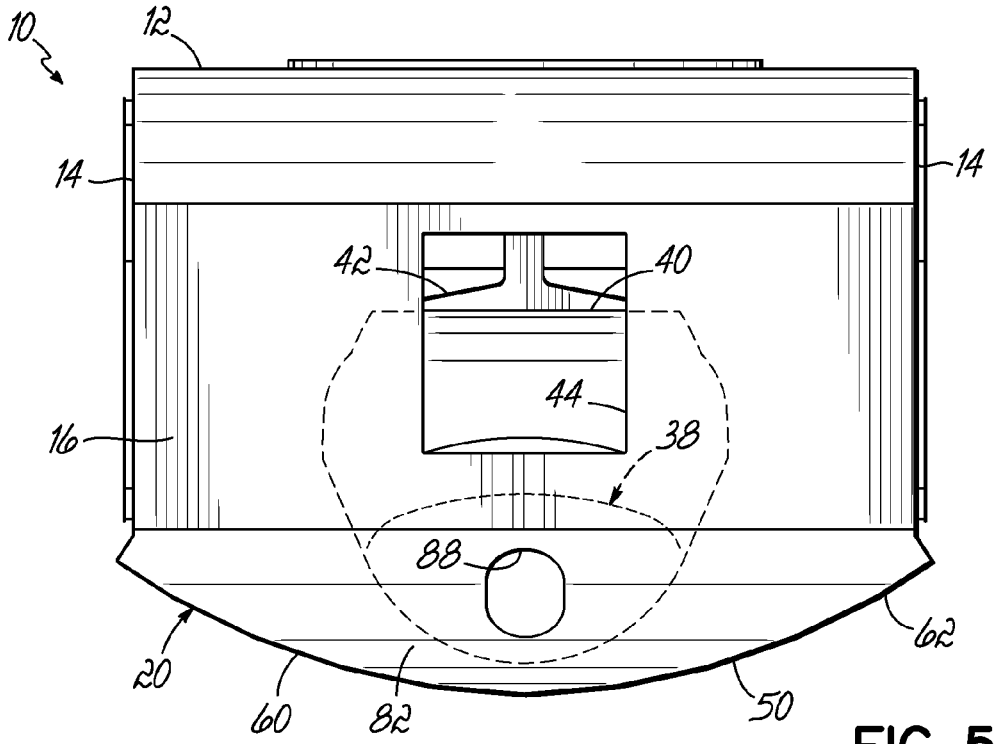
FIG. 5 is a rear view of the cab of FIGS. 1-4.
Figure 6:
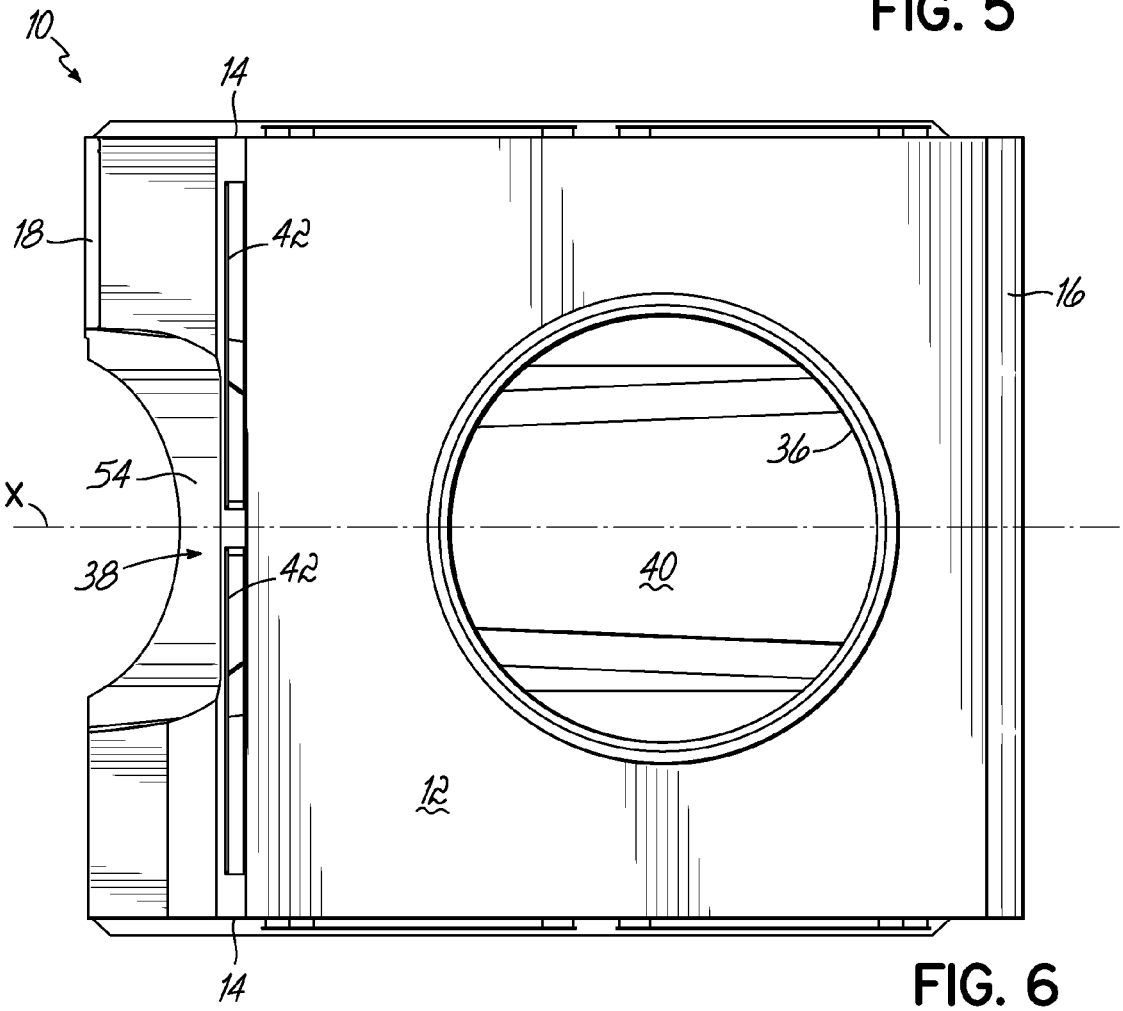
FIG. 6 is a top view of the cab of FIGS. 1-5.
Figure 7:
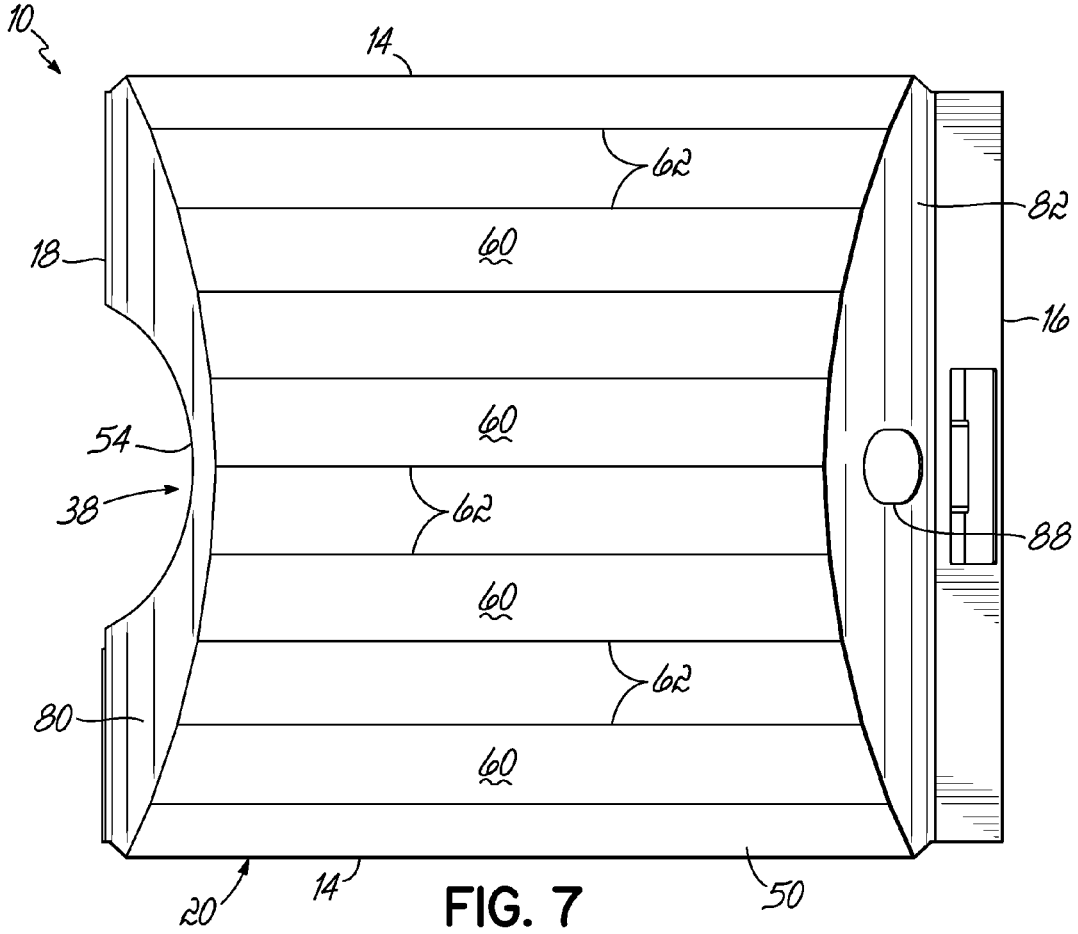
FIG. 7 is a bottom view of the cab of FIGS. 1-6.

Referring to FIGS. 1-7, an exemplary cab 10 embodying the principles of the present invention is illustrated. The cab 10 has a top wall 12, side walls 14, 14, a back wall or walls 16, a front wall or walls 18, and a bottom wall 20. As illustrated, cab 10 is for the High Mobility Multipurpose Wheeled Vehicle ("HMMWV") series of vehicles, although the cab 10 can be used on other light tactical vehicles or other tactical vehicles as well. The side walls 14, 14 can each include one or more door openings 32, 34 for suitable armored doors, and top wall 12 can include a gun turret opening 36 for a suitable gun turret. The cab 10 can further include a power train tunnel 38 the length of the cab 10 which is defined by bottom wall 20 and power train tunnel upper wall 40. Front wall or walls 18 can include one or more window openings 42, 42 for suitable transparent armored glass or other transparent armored material. Back wall or walls 16 can include a window or door opening 44 for suitable transparent armored glass or other transparent armored material or a suitable armored door. The cab walls can be made of any high strength and high ductility material such as armored steel, high hard steel, Advanced High Strength Steel ("AHSS") or other suitable material whether metallic or non-metallic; expensive exotic materials are not required.

Figure 8:
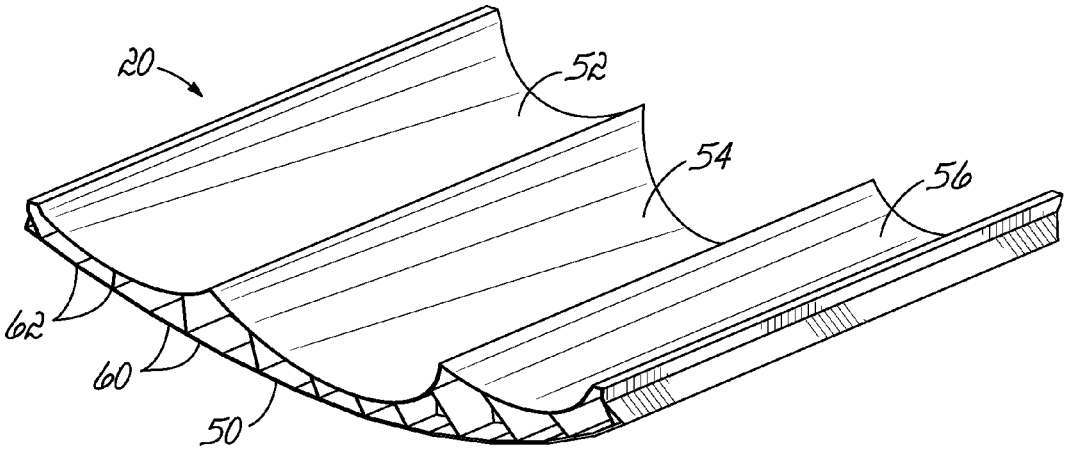
FIG. 8 is a top perspective view of the bottom wall of the cab of FIGS. 1-7.
Figure 9:
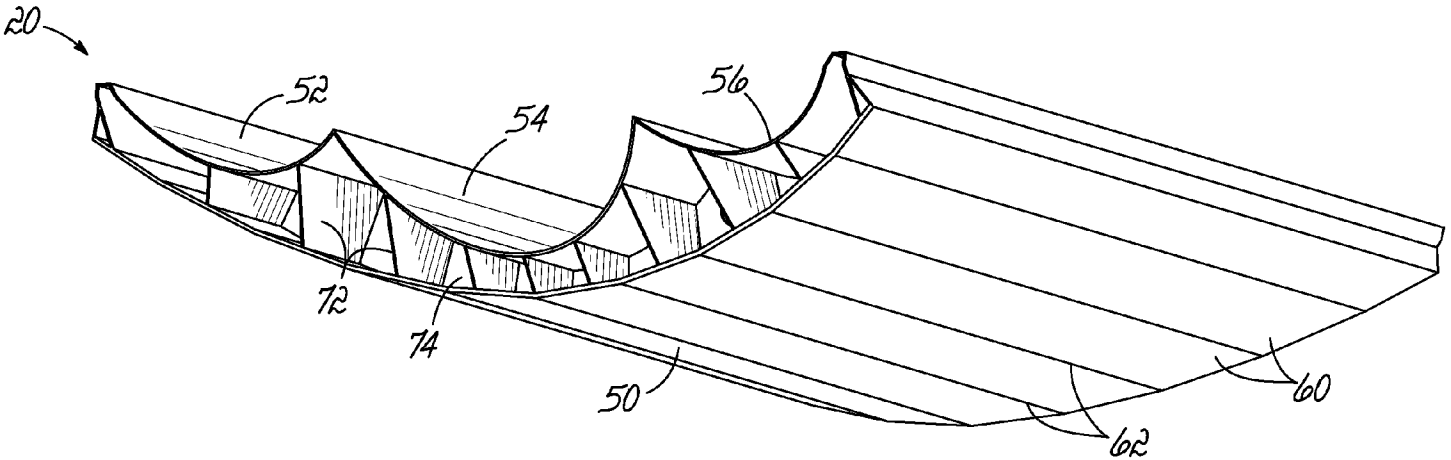
FIG. 9 is a bottom perspective view of the bottom wall of the cab of FIG. 8.
Figure 10:
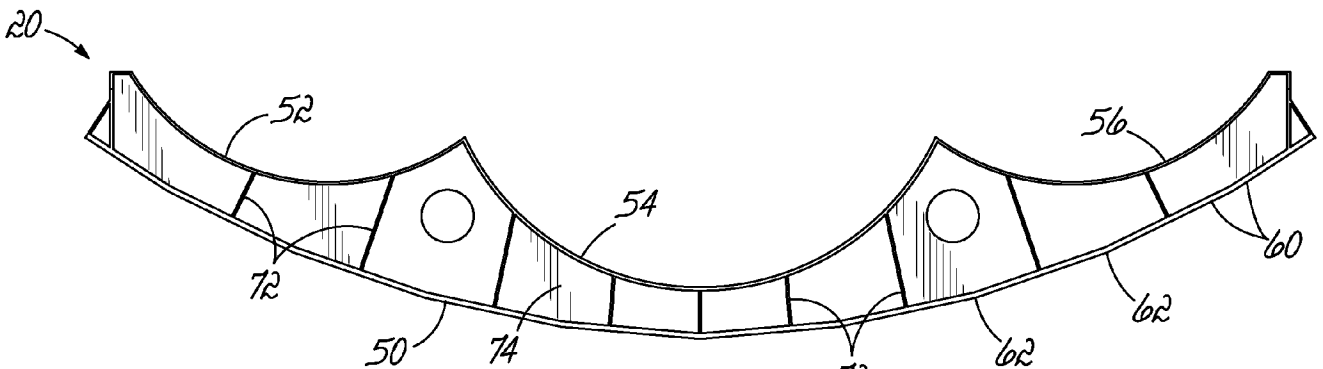
FIG. 10 is a front view of the bottom wall of the cab of FIGS. 8 and 9.

Referring to FIGS. 8-13, the bottom wall 20 of the cab 10 is shown in more detail. Referring first to FIGS. 8-10, the bottom wall 20 includes a first downwardly facing convex wall 50 generally parallel to the longitudinal axis X of the cab 10, and at least a second downwardly facing convex wall 52 generally parallel to the longitudinal axis X of the cab 10 above the first convex wall 50. Preferably, but not necessarily, the bottom wall 20 includes second 52, third 54, and fourth 56 downwardly facing convex walls positioned across a transverse extent of the first downwardly facing wall 50. Convex walls 50, 52, 54, 56 can be any arched shape, examples of which include cylindrical, frustoconical, ellipsoid, paraboloid, egg-shaped, and the like. In the exemplary illustrated embodiment, the convex walls 50, 52, 54, 56 are cylindrical, i.e. are portions of cylinders, with the first convex wall 50 having a radius of curvature that is larger than the respective radius of curvature of each of the second, third, and fourth convex walls 52, 54, 56, and with the third convex wall 54 having a radius of curvature that is larger than the respective radius of curvature of each of the second and fourth convex walls 52, 56. By way of example, the first convex wall 50 can have a radius of about 2300 millimeters, the second convex wall 52 can have a radius of about 400 millimeters, the third convex wall 54 can have a radius of about 450 millimeters, and the fourth convex wall 56 can have a radius of about 400 millimeters. Other acceptable radii dimensions are of course possible.

Any or all of the first, second, third, and fourth convex walls 50, 52, 54, 56 can be smoothly or continuously convex, or discontinuously convex or "faceted." By way of illustration, first convex wall 50 can be smoothly or continuously convex, or it can be discontinuously convex or "faceted," as illustrated in the exemplary illustrated embodiment. For example, first convex wall 50 can be formed from a plurality of elongated connected planar sections 60 that are generally parallel to the longitudinal axis X of the cab 10. Such a faceted construction further enhances the blast deflection capability of the bottom wall 20. The convex wall 50 can be manufactured from a single seamless sheet of material that is bent along a plurality of bend lines 62 to form the planar sections 60, or the convex wall 50 can be manufactured from a plurality of individual planar sections 60 that are joined along abutting edges 62 as by welding, bolting, or the like. The planar sections 60 can preferably be angled relative to one another by less than about 18 degrees. Other acceptable angles are of course possible.

Figure 11:
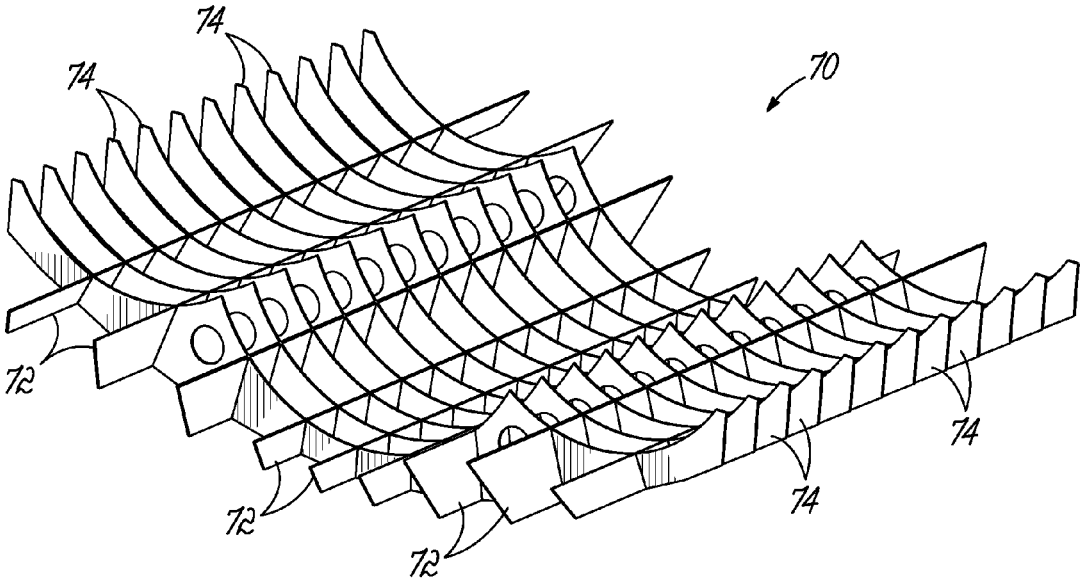
FIG. 11 is a top perspective view of the connecting members of the bottom wall of FIGS. 8-10.
Figure 12:
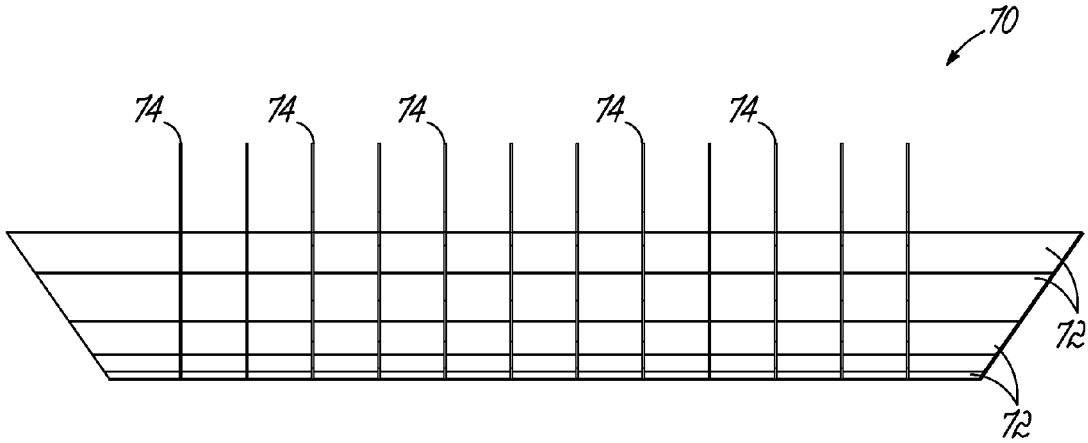
FIG. 12 is a side view of the connecting members of FIG. 11.
Figure 13:
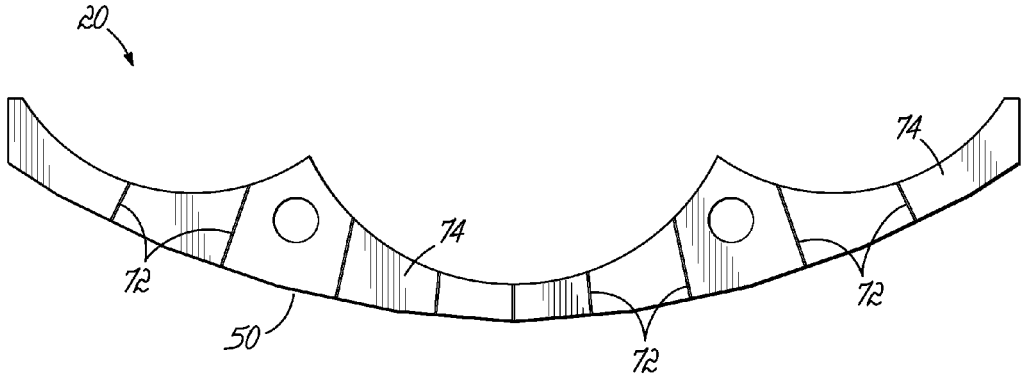
FIG. 13 is a front view of the connecting members of FIGS. 11 and 12.
Figure 14:
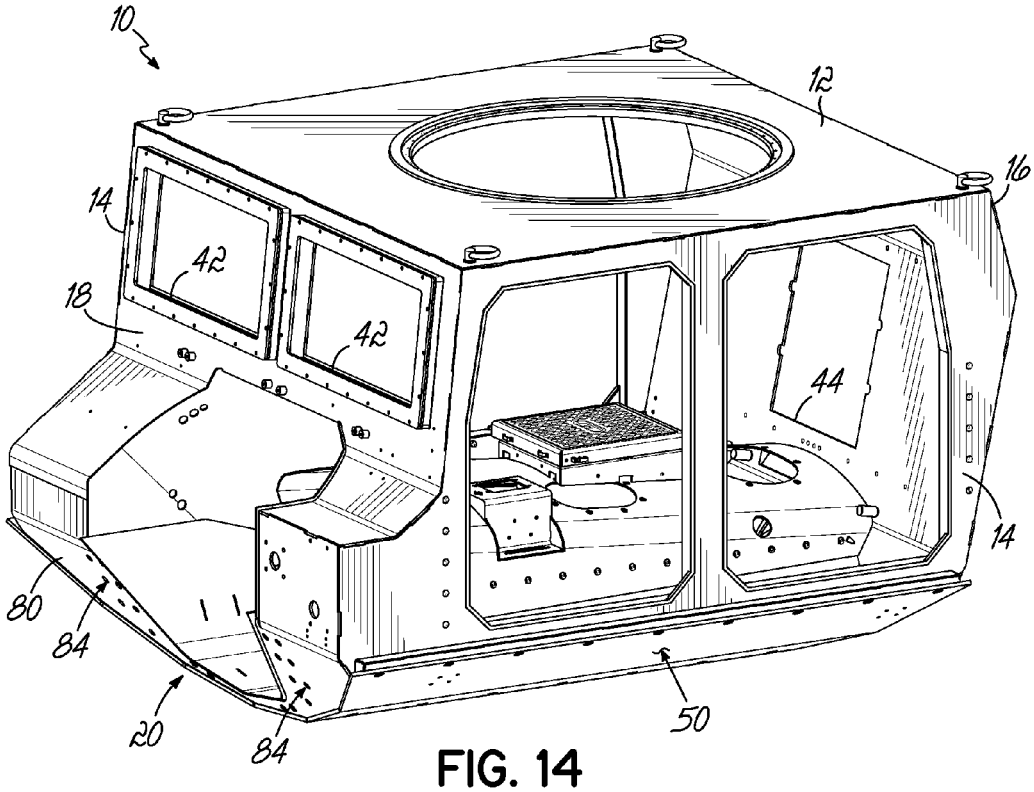
FIG. 14 is a top perspective view of an alternative embodiment cab according to the principles of the invention.
Figure 15:
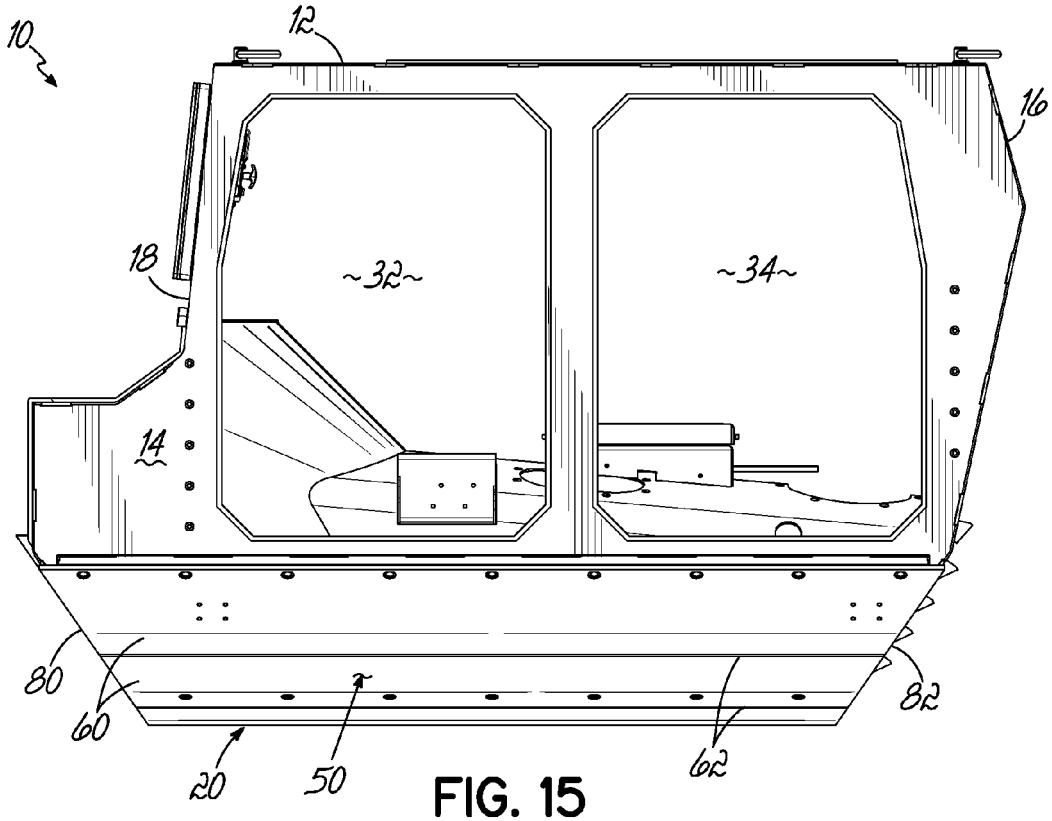
FIG. 15 is a side view of the cab of FIG. 14.
Figure 16:
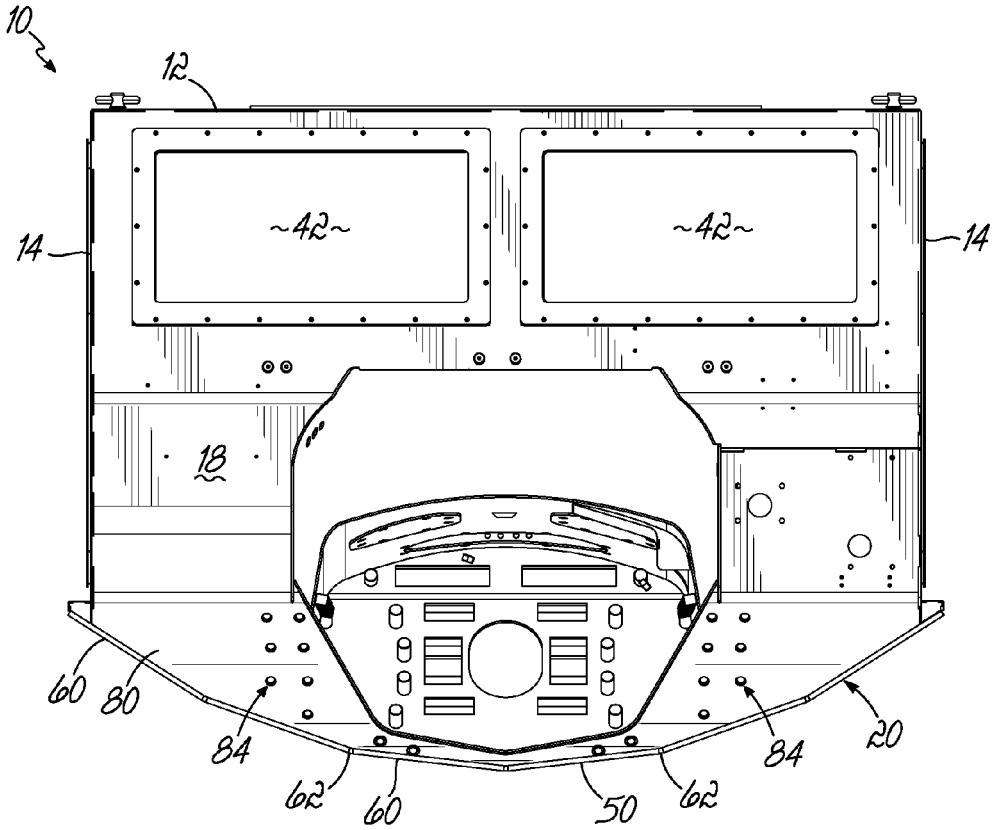
FIG. 16 is a front view of the cab of FIGS. 14 and 15.
Figure 17:
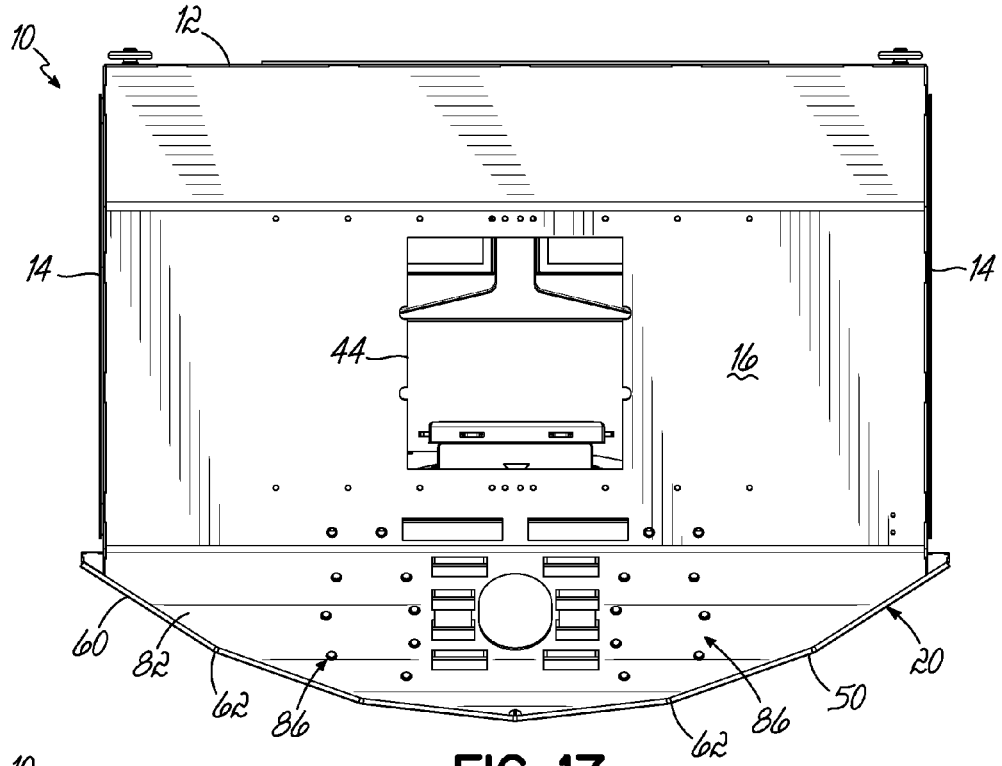
FIG. 17 is a rear view of the cab of FIGS. 14-16.
Figure 18:
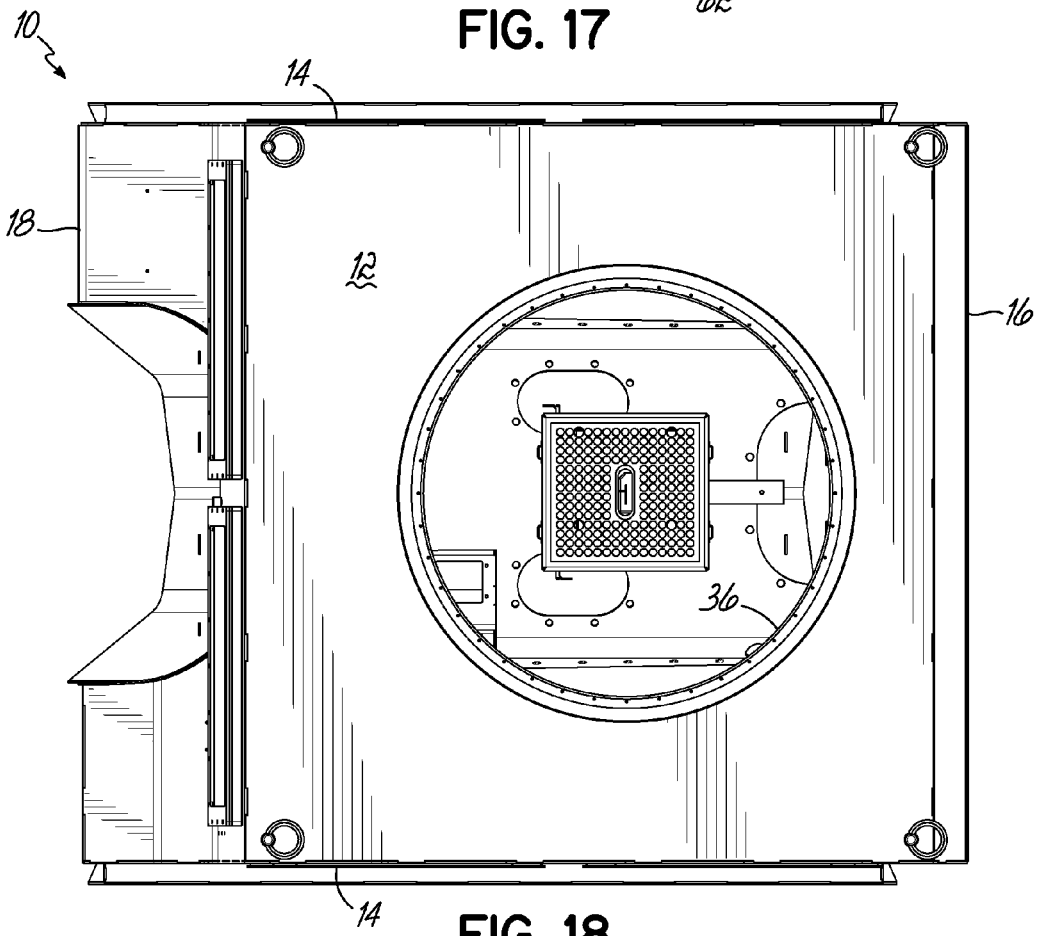
FIG. 18 is a top view of the cab of FIGS. 14-17.
Figure 19:
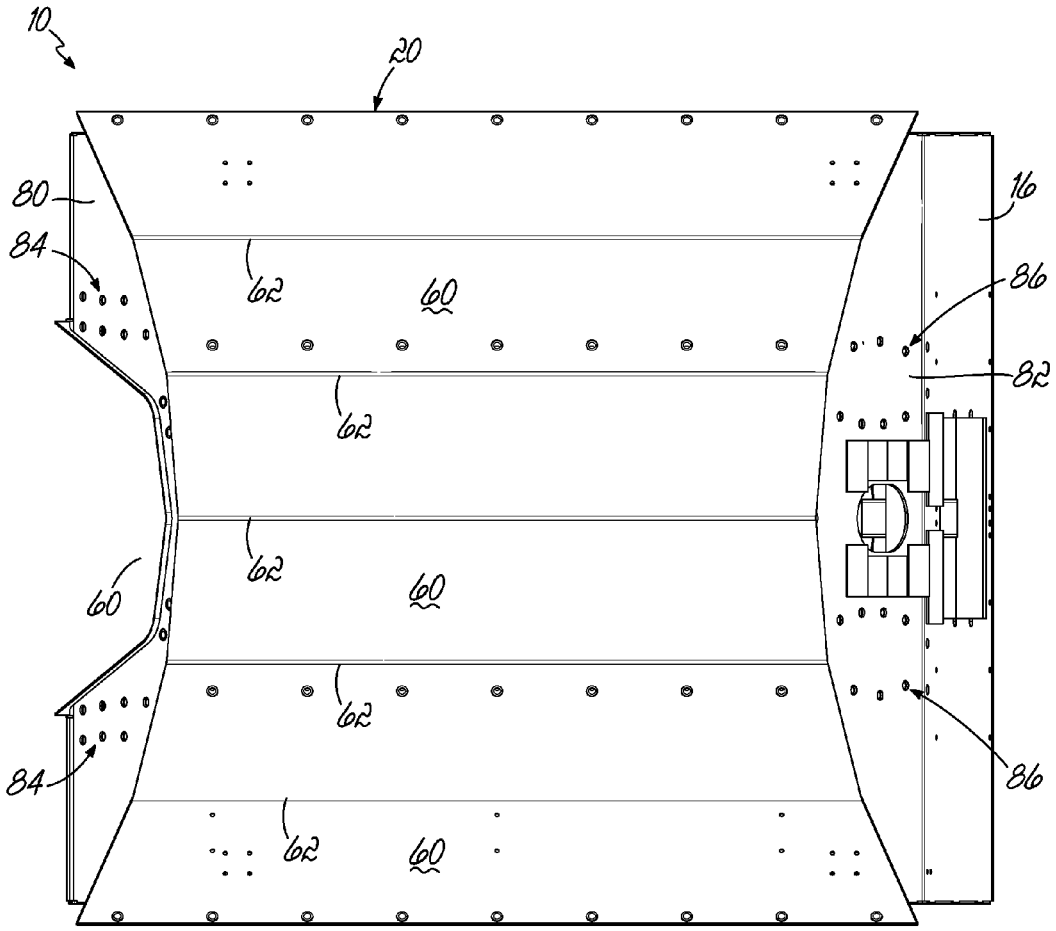
FIG. 19 is a bottom view of the cab of FIGS. 14-18.

Referring to FIGS. 11-13, a plurality of connecting members 70 interconnect the first convex wall 50 and the second, third, and fourth convex walls 52, 54, 56. Connecting members 70 can take the form of a first plurality of ribs or trusses 72 generally parallel to the longitudinal axis X of the cab 10 and a second plurality of ribs or trusses 74 generally perpendicular or transverse to the longitudinal axis X of the cab 10. The first and second pluralities of ribs 72, 74 can preferably be connected to the first, second, third, and fourth convex walls 50, 52, 54, 56 and to each other. In the exemplary embodiment illustrated, with first convex wall 50 being formed of ten planar sections 60, there are nine longitudinal ribs 72 and twelve transverse ribs 74. Other acceptable numbers of planar sections 60, longitudinal ribs 72, and transverse ribs 74 are of course possible. As illustrated, the longitudinal ribs 72 and transverse ribs 74 can be shaped such their upper and lower edges are in intimate contact, along their entire respective lengths, with the upwardly facing surface of the first convex wall 50 and the downwardly facing surfaces of the second, third, and fourth convex walls 52, 54, 56. Thus, when the ribs 72, 74 are attached to one another and to the first, second, third, and fourth convex walls 50, 52, 54, 56 as by welding, bolting, or the like, the result is a very stiff composite structure that is resistant to blast-induced deflections.

Referring to FIGS. 14-19, an alternative embodiment of cab 10 is illustrated. With like numbers representing like elements, the first convex wall 50 of the bottom wall 20 of this embodiment of cab 10 is also "faceted," but six planar sections 60 are utilized rather than ten planar sections 60 in the prior embodiment.

The cab 10 of the present invention can either be incorporated into an originally manufactured vehicle, or it can be retro-fitted into an existing vehicle. For example, in the case of the HMMWV vehicle, this vehicle can be retrofitted or "recapped" with the cab 10 of the present invention. To retrofit the HMMWV vehicle with the cab 10 of the present invention, the middle portions of the vehicle's frame rails are removed. The cab 10 of the present invention in essence replaces those frame rail middle portions. Two front brackets are welded to the ends of the remaining front portions of the frame rails (front "frame rail stubs") and are then bolted to the front of the cab 10, and two rear brackets are welded to the ends of the remaining rear portions of the frame rails ("rear frame rail stubs") and are then bolted to the rear of the cab 10. For example, with reference to FIGS. 1-7 and 14-19, it will be seen that bottom wall 20 can include a front end plate or wall 80, for example planar front end wall 80, and a rear end plate or wall 82, for example planar rear end wall 82. Referring to FIGS. 14-19, front end wall 80 can include a pair of bolt hole patterns 84, 84 and rear end wall 82 can include a pair of bolt hole patterns 86, 86. Bolt hole patterns 84, 84 are for bolting the two front frame rail brackets to the front of the cab 10; bolt hole patterns 86, 86 are for bolting the two rear frame rail brackets to the rear of the cab 10. An opening 88 in the rear end wall 82 allows the drive shaft to pass therethrough to the rear axle of the vehicle. Bottom wall 20 can be configured such that front end wall 80 angles or extends downwardly and rearwardly from an upper front edge thereof as illustrated, and such that rear end wall 82 angles or extends downwardly and forwardly from an upper rear edge thereof as illustrated, to further enhance the blast deflection capability of the bottom wall 20.

Figure 20A:
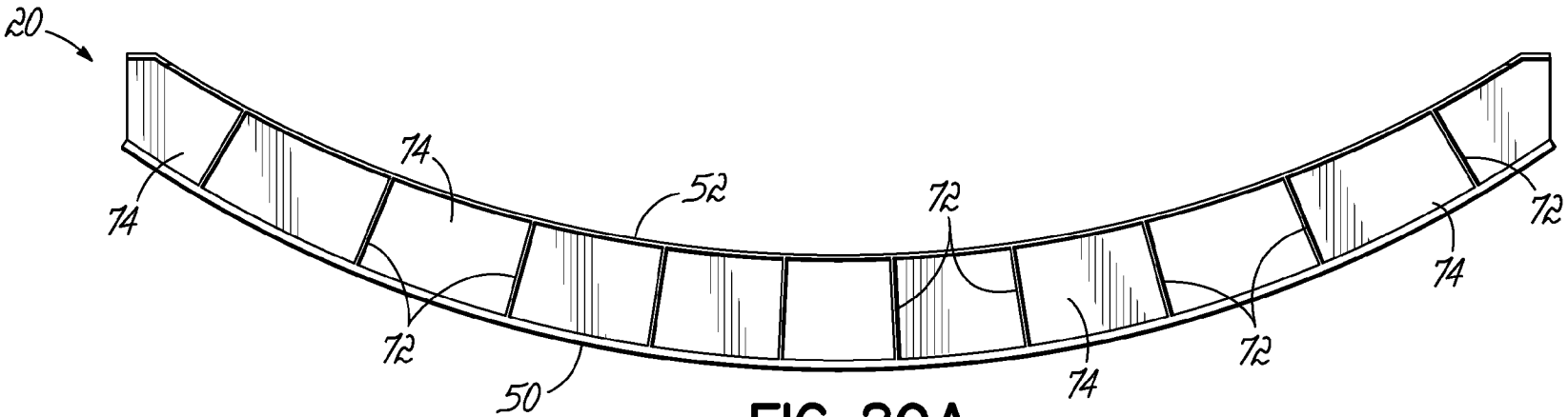
FIGS. 20A-20E are front views of alternative embodiments of the bottom wall of the cab.
Figure 20B:
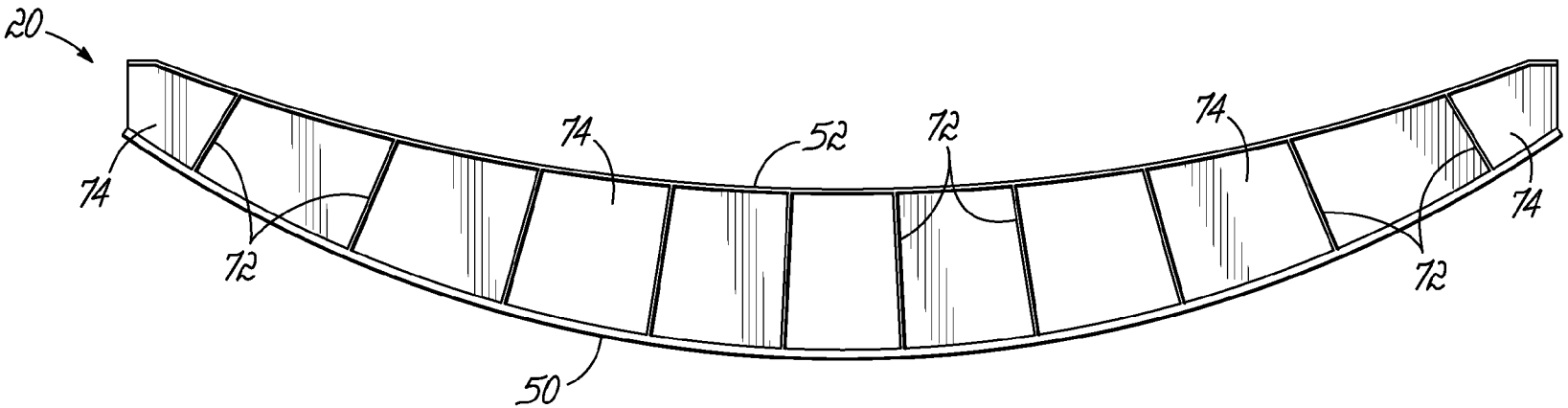
Figure 20C:
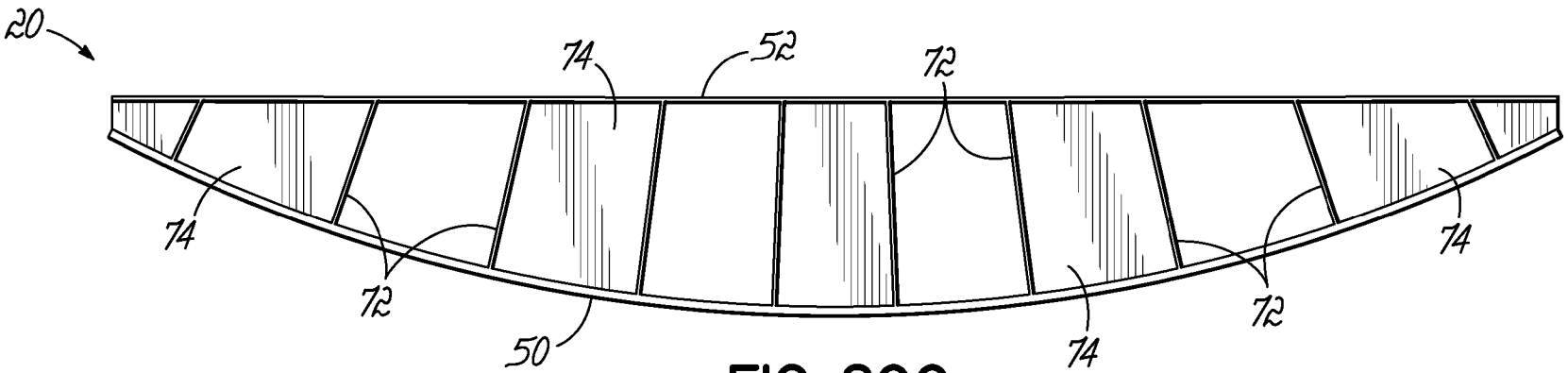
Figure 20D:
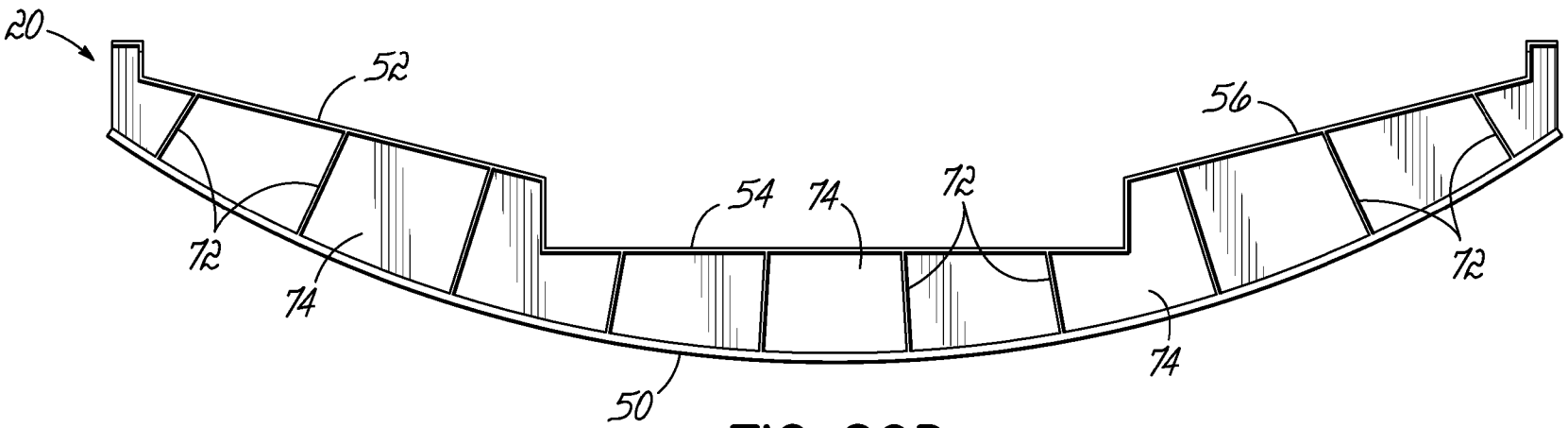
Figure 20E:
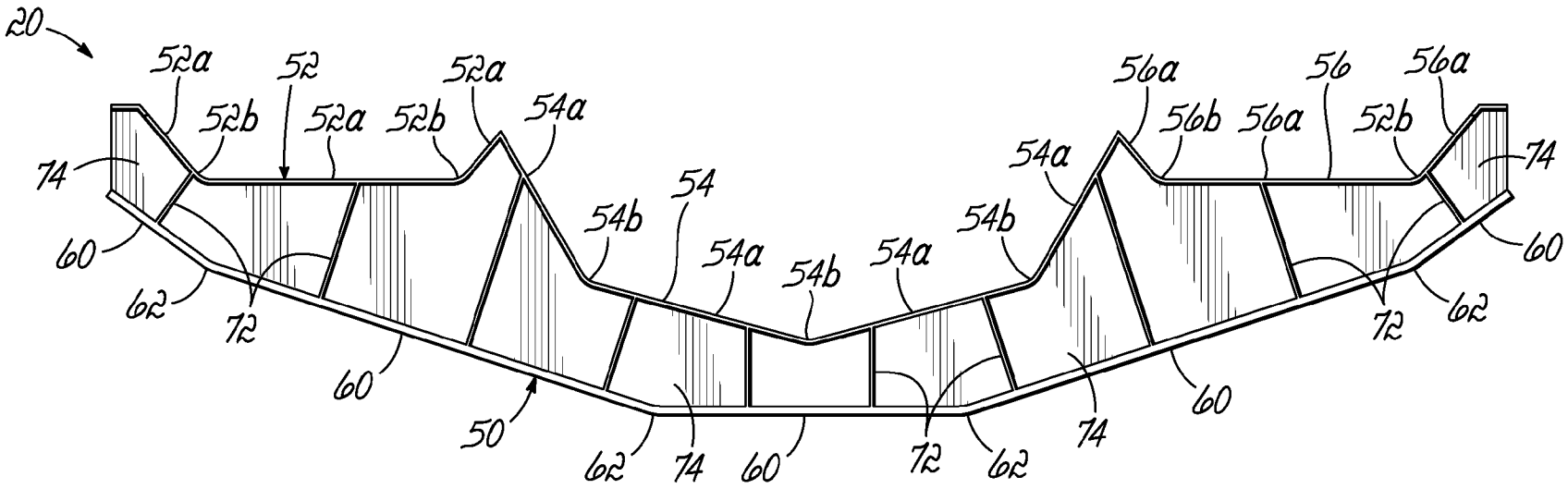

Referring to FIGS. 20A-20E, with like numbers representing like elements, further alternative embodiments of the bottom wall 20 of the cab 10 are illustrated. FIG. 20A illustrates the first and second convex walls 50, 52 having about the same radius of curvature. FIG. 20B illustrates the second convex wall 52 having a radius of curvature greater than the radius of curvature of the first convex wall 50. FIG. 20C illustrates the second wall 52 being a planar wall. FIG. 20D illustrates the second, third, and fourth walls 52, 54, 56 being planar walls generally parallel to the longitudinal axis X of the cab 10 positioned across a transverse extent of the first convex wall 50, with the second, third, and fourth walls 52, 54, 56 being angled relative to one another. FIG. 20E illustrates the first, second, third, and fourth convex walls 50, 52, 54, 56 all being discontinuously convex or faceted. For example, the first convex wall 50 can be formed from five elongated connected planar sections 60 generally parallel to the longitudinal axis X of the cab 10 bent along bend lines 62 or joined along abutting edges 62. The second convex wall 52 can be formed from three elongated connected planar sections 52*a* generally parallel to the longitudinal axis X of the cab 10 bent along bend lines 52*b* or joined along abutting edges 52*b*. The third convex wall 54 can be formed from four elongated connected planar sections 54*a* generally parallel to the longitudinal axis X of the cab 10 bent along bend lines 54*b* or joined along abutting edges 54*b*. The fourth convex wall 56 can be formed from three elongated connected planar sections 56*a* generally parallel to the longitudinal axis X of the cab 10 bent along bend lines 56*b* or joined along abutting edges 56*b*.

The armored cab 10 thus helps to cost-effectively meet weight and mine blast requirements for light tactical vehicles without exceeding vehicle height requirements and while maintaining sufficient vehicle ground clearance. The construction of the bottom wall 20 of the cab 10, through the use of lower convex wall 50 and one or more upper convex or planar walls 52, 54, 56 interconnected with connecting members 72, 74, provides a very stiff yet comparatively lightweight composite structure that is resistant to blast-induced deflections. The exemplary radius dimension of the first convex wall 50 discussed above, and/or the exemplary number of planar sections 60 from which to construct the convex wall 50 and the exemplary bend angles between those planar sections 60 discussed above, help to provide sufficient vehicle ground clearance without exceeding vehicle height limits. Forming the lower portion of the enclosure of the power train tunnel 38 with the bottom wall 20 further stiffens the cab 10 and allows the cab 10 to essentially replace the middle portions of a vehicle's frame rails, thus avoiding the necessity of designing the cab bottom armoring to accommodate the frame rails, which can sometimes compromise the armoring.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. The invention in its broader aspects is therefore not limited to the specific details and representative apparatus and methods shown and described. Departures may therefore be made from such details without departing from the scope or spirit of applicants' general inventive concept. Accordingly, the scope of the invention shall be limited only by the following claims and their equivalents.

What is claimed is:

1. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab, at least a second downwardly facing convex wall generally parallel to said longitudinal axis of said cab above said first convex wall, and a plurality of connecting members interconnecting said first convex wall and said at least a second convex wall, wherein said at least a second convex wall comprises second, third and fourth downwardly facing convex walls generally parallel to said longitudinal axis of said cab positioned side-by-side across a transverse extent of said first convex wall.

2. The armored cab of claim 1 wherein said first, second, third, and fourth convex walls are cylindrical.

3. The armored cab of claim 2 wherein said first convex wall has a first radius of curvature, said second convex wall has a second radius of curvature, said third convex wall has a third radius of curvature, and said fourth convex wall has a fourth radius of curvature, and wherein said first radius of curvature is greater than said second radius of curvature, said third radius of curvature, and said fourth radius of curvature.

4. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab, at least a second downwardly facing convex wall generally parallel to said longitudinal axis of said cab above said first convex wall, and a plurality of connecting members interconnecting said first convex wall and said at least a second convex wall, wherein said at least a second convex wall comprises second, third and fourth downwardly facing convex walls generally parallel to said longitudinal axis of said cab positioned side-by-side across a transverse extent of said first convex wall, wherein said first, second, third, and fourth convex walls are cylindrical, wherein said first convex wall has a first radius of curvature, said second convex wall has a second radius of curvature said third convex wall has a third radius of curvature, and said fourth convex wall has a fourth radius of curvature, and wherein said first radius of curvature is greater than said second radius of curvature, said third radius of curvature, and said fourth radius of curvature, wherein said third radius of curvature is greater than said second radius of curvature and said fourth radius of curvature, and wherein said third convex wall is positioned between said second convex wall and said fourth convex wall.

5. The armored cab of claim 4 wherein said first radius of curvature is about 2300 millimeters, said second radius of curvature is about 400 millimeters, said third radius of curvature is about 450 millimeters, and said fourth radius of curvature is about 400 millimeters.

6. The armored cab of claim 1 wherein said plurality of connecting members comprises a first plurality of ribs generally parallel to said longitudinal axis of said cab and a second plurality of ribs generally perpendicular to said longitudinal axis of said cab, said first and second pluralities of ribs connected to said first convex wall, to said at least a second convex wall, and to each other.

7. The armored cab of claim 1 wherein said first convex wall is formed from a plurality of elongated connected planar sections generally parallel to said longitudinal axis of said cab.

8. The armored cab of claim 7 wherein said planar sections are angled relative to one another by less than about 18 degrees.

9. The armored cab of claim 7 wherein said first convex wall is formed from six said planar sections.

10. The armored cab of claim 7 wherein said first convex wall is formed from ten said planar sections.

11. The armored cab of claim 10 wherein said plurality of connecting members comprises a first plurality of ribs generally parallel to said longitudinal axis of said cab and a second plurality of ribs generally perpendicular to said longitudinal axis of said cab, said first and second pluralities of ribs connected to said first convex wall, to said at least a second convex wall, and to each other.

12. The armored cab of claim 11 wherein said first plurality of ribs generally parallel to said longitudinal axis of said cab comprises nine ribs.

13. The armored cab of claim 11 wherein said second plurality of ribs generally perpendicular to said longitudinal axis of said cab comprises twelve ribs.

14. The armored cab of claim 1 further including a power train tunnel, said bottom wall forming a lower portion of a power train tunnel enclosure defining said power train tunnel.

15. The armored cab of claim 1 wherein said bottom wall further includes a front end wall and a rear end wall, said front end wall extending downwardly and rearwardly from an upper front edge thereof, said rear end wall extending downwardly and forwardly from an upper rear edge thereof.

16. The armored cab of claim 15 wherein said front end wall and said rear end wall are planar.

17. The armored cab of claim 15 wherein said front end wall and said rear end wall are adapted to have attached thereto front frame rail stubs and rear frame rail stubs, respectively, of a vehicle frame.

18. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab and second, third and fourth downwardly facing convex walls generally parallel to said longitudinal axis of said cab above said first convex wall and positioned side-by-side across a transverse extent of said first convex wall, and a plurality of connecting members interconnecting said first convex wall and said second, third, and fourth convex walls, said plurality of connecting members comprising a first plurality of ribs generally parallel to said longitudinal axis of said cab and a second plurality of ribs generally perpendicular to said longitudinal axis of said cab, said first and second pluralities of ribs connected to said first, second, third, and fourth convex walls and to each other, said cab further including a power train tunnel, said bottom wall forming a lower portion of a power train tunnel enclosure defining said power train tunnel.

19. The armored cab of claim 18 wherein said first, second, third, and fourth convex walls are cylindrical.

20. The armored cab of claim 19 wherein said first convex wall has a first radius of curvature, said second convex wall has a second radius of curvature, said third convex wall has a third radius of curvature, and said fourth convex wall has a fourth radius of curvature, and wherein said first radius of curvature is greater than said second radius of curvature, said third radius of curvature, and said fourth radius of curvature.

21. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab and second, third and fourth downwardly facing convex walls generally parallel to said longitudinal axis of said cab above said first convex wall and positioned side-by-side across a transverse extent of said first convex wall, and a plurality of connecting members interconnecting said first convex wall and said second, third, and fourth convex walls, said plurality of connecting members comprising a first plurality of ribs generally parallel to said longitudinal axis of said cab and a second plurality of ribs generally perpendicular to said longitudinal axis of said cab, said first and second pluralities of ribs connected to said first, second, third, and fourth convex walls and to each other, said cab further including a power train tunnel, said bottom wall forming a lower portion of a power train tunnel enclosure defining said power train tunnel, wherein said first, second, third, and fourth convex walls are cylindrical, wherein said first convex wall has a first radius of curvature, said second convex wall has a second radius of curvature, said third convex wall has a third radius of curvature, and said fourth convex wall has a fourth radius of curvature, and wherein said first radius of curvature is greater than said second radius of curvature, said third radius of curvature, and said fourth radius of curvature, wherein said third radius of curvature is greater than said second radius of curvature and said fourth radius of curvature, and wherein said third convex wall is positioned between said second convex wall and said fourth convex wall.

22. The armored cab of claim 21 wherein said first radius of curvature is about 2300 millimeters, said second radius of curvature is about 400 millimeters, said third radius of curvature is about 450 millimeters, and said fourth radius of curvature is about 400 millimeters.

23. The armored cab of claim 20 wherein said first convex wall is formed from a plurality of elongated connected planar sections generally parallel to said longitudinal axis of said cab.

24. The armored cab of claim 23 wherein said planar sections are angled relative to one another by less than about 18 degrees.

25. The armored cab of claim 23 wherein said first convex wall is formed from ten said planar sections.

26. The armored cab of claim 25 wherein said first plurality of ribs generally parallel to said longitudinal axis of said cab comprises nine ribs.

27. The armored cab of claim 25 wherein said second plurality of ribs generally perpendicular to said longitudinal axis of said cab comprises twelve ribs.

28. The armored cab of claim 20 wherein said bottom wall further includes a front end wall and a rear end wall, said front end wall extending downwardly and rearwardly from an upper front edge thereof, said rear end wall extending downwardly and forwardly from an upper rear edge thereof.

29. The armored cab of claim 28 wherein said front end wall and said rear end wall are planar.

30. The armored cab of claim 28 wherein said front end wall and said rear end wall are adapted to have attached thereto front frame rail stubs and rear frame rail stubs, respectively, of a vehicle frame.

31. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab, at least a second wall generally parallel to said longitudinal axis of said cab above said first convex wall, and a plurality of connecting members interconnecting said first convex wall and said at least a second wall, wherein said at least a second wall is a downwardly facing convex wall, wherein said first convex wall has a first radius of curvature, said at least a second convex wall has a second radius of curvature, and said second radius of curvature is greater than said first radius of curvature.

32. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab, at least a second wall generally parallel to said longitudinal axis of said cab above said first convex wall, and a plurality of connecting members interconnecting said first convex wall and said at least a second wall, wherein said at least a second wall comprises second, third, and fourth planar walls generally parallel to said longitudinal axis of said cab positioned side-by-side across a transverse extent of said first convex wall, said second, third, and fourth planar walls angled relative to one another.

33. An armored cab comprising:

a top wall, two side walls, a front wall, a back wall, and a bottom wall, said cab having a longitudinal axis extending from said back wall to said front wall, said bottom wall including a first downwardly facing convex wall generally parallel to said longitudinal axis of said cab, at least a second wall generally parallel to said longitudinal axis of said cab above said first convex wall, and a plurality of connecting members interconnecting said first convex wall and said at least a second wall, wherein said at least a second wall comprises second, third, and fourth downwardly facing convex walls generally parallel to said longitudinal axis of said cab positioned side-by-side across a transverse extent of said first convex wall, said second convex wall formed from three elongated connected planar sections generally parallel to said longitudinal axis of said cab, said third convex wall formed from four elongated connected planar sections generally parallel to said longitudinal axis of said cab, and said fourth convex wall formed from three elongated connected planar sections generally parallel to said longitudinal axis of said cab.

34. The armored cab of claim 33 wherein said first convex wall is formed from five elongated connected planar sections generally parallel to said longitudinal axis of said cab.

35. The armored cab of any one of claims 31, 32, and 33 wherein said plurality of connecting members comprises a first plurality of ribs generally parallel to said longitudinal axis of said cab and a second plurality of ribs generally perpendicular to said longitudinal axis of said cab, said first and second pluralities of ribs connected to said first convex wall, to said at least a second wall, and to each other.

36. The armored cab of claim 35 further including a power train tunnel, said bottom wall forming a lower portion of a power train tunnel enclosure defining said power train tunnel.

37. The armored cab of claim 35 wherein said bottom wall further includes a front end wall and a rear end wall, said front end wall extending downwardly and rearwardly from an upper front edge thereof, said rear end wall extending downwardly and forwardly from an upper rear edge thereof.

38. The armored cab of claim 37 wherein said front end wall and said rear end wall are planar.

39. The armored cab of claim 38 wherein said front end wall and said rear end wall are adapted to have attached thereto front frame rail stubs and rear frame rail stubs, respectively, of a vehicle frame.

40. The armored cab of claim 1 wherein each of said second, third, and fourth downwardly facing convex walls is formed from a plurality of elongated connected planar sections generally parallel to said longitudinal axis of said cab.

41. The armored cab of claim 7 wherein each of said second, third, and fourth downwardly facing convex walls is formed from a plurality of elongated connected planar sections generally parallel to said longitudinal axis of said cab.

* * * * *

UNITED STATES PATENT AND TRADEMARK OFFICE

CERTIFICATE OF CORRECTION

PATENT NO. : 8,616,617 B2
APPLICATION NO. : 13/279912
DATED : December 31, 2013
INVENTOR(S) : Timothy David Sherbeck et al.

It is certified that error appears in the above-identified patent and that said Letters Patent is hereby corrected as shown below:

In the Claims

At Column 7, line 27, Claim 4, after "curvature" insert --,--

Signed and Sealed this
Twenty-ninth Day of December, 2015

Michelle K. Lee

Michelle K. Lee
*Director of the United States Patent and Trademark Office*